United States Patent [19]

Wagner

[11] Patent Number: 4,731,763

[45] Date of Patent: Mar. 15, 1988

[54] SONAR ANTENNA FOR USE AS THE HEAD OF AN UNDERWATER DEVICE, AND METHOD FOR MANUFACTURING THE SAME

[75] Inventor: Jean-Marie L. Wagner, Cavalaire Sur Mer, France

[73] Assignee: Etat Francais, Paris, France

[21] Appl. No.: 45,712

[22] Filed: Mar. 26, 1987

Related U.S. Application Data

[63] Continuation of Ser. No. 509,220, Jun. 22, 1983, abandoned.

[30] Foreign Application Priority Data

Jun. 22, 1982 [FR] France ..... 82 10846

[51] Int. Cl.[4] ..... H04R 1/02; F42B 19/01

[52] U.S. Cl. ..... 367/153; 367/173; 367/176; 29/602 A; 114/21.3; 264/272.16

[58] Field of Search ..... 367/106, 130, 137, 140, 367/141, 153, 155, 157, 162, 165, 167, 172, 173, 176, 180, 188; 114/20.1, 20.2, 20.3, 21.1, 21.2, 21.3, 22, 23, 24, 25; 29/594, 602 A; 264/272.11, 272.12, 272.14, 272.16, 272.18; 310/337, 340

[56] References Cited

U.S. PATENT DOCUMENTS

| | | | |
|---|---|---|---|
| 2,899,923 | 8/1959 | Daly et al. | 114/20 R |
| 3,113,287 | 12/1963 | Renner | 367/165 |
| 3,139,056 | 6/1964 | Boswell et al. | 114/22 |
| 3,296,586 | 1/1967 | Midlock et al. | 367/157 X |
| 3,353,150 | 11/1967 | Jacox | 367/155 |
| 3,372,662 | 3/1968 | Nisewanger | 114/20 R |
| 3,663,934 | 5/1972 | Whitehouse et al. | 367/153 |
| 4,004,266 | 1/1977 | Cook et al. | 367/155 |
| 4,110,727 | 8/1978 | Kriege | 367/157 |
| 4,192,246 | 3/1980 | Hodges et al. | 367/155 X |
| 4,463,454 | 7/1984 | Hemond et al. | 367/173 |

*Primary Examiner*—Deborah L. Kyle
*Assistant Examiner*—Brian S. Steinberger
*Attorney, Agent, or Firm*—Parkhurst & Oliff

[57] ABSTRACT

A sonar antenna is provided which can serve as the head of an underwater device, e.g., a torpedo, and a method for manufacturing the same. The sonar antenna is formed of a block of syntactic foam rigid enough to withstand submersion hydrostatic pressures. The block has a plurality of housings formed in the outer surface thereof, with at least one electro-acoustic transducer in at least one housing flush with the outer surface of the block. The base of the block is provided with a flanged sleeve by which the antenna can be mounted to the front end of the underwater device, with an acoustic decoupling fitting provided between the flange and the underwater device. The entire block, transducers and flange are surrounded by a sealed envelope which is transparent to acoustic waves. The outer surface of the sealed envelope serves as the outer surface of the sonar antenna and as the front end of the underwater device.

10 Claims, 3 Drawing Figures

SONAR ANTENNA FOR USE AS THE HEAD OF AN UNDERWATER DEVICE, AND METHOD FOR MANUFACTURING THE SAME

This is a continuation of application Ser. No. 509,220, filed June 22, 1983 and now abandoned.

BACKGROUND OF THE INVENTION

This invention pertains to sonar antennas designed to be loaded onto an underwater device in order to form an inserted head of that device and a method for manufacturing these antennas.

The technical field of the invention is that of the assembly of sonar antennas for acoustic homing devices on underwater devices, especially torpedos.

A sonar antenna is a collection of electro-acoustic transducers, for instance, piezo-electric transducers, which are arranged in a network to transmit acoustic waves in water, or to receive acoustic waves which are echos of transmitted waves, or which are waves transmitted by a target.

To this day, sonar antennas used in underwater devices are comprised of a mosaic of transducers which are arranged inside the cone-shaped head of the device. The transducers are supported on a plug, which may or may not be removable, by a material having an acoustic impedance as different as possible from that of the plug, so as to acoustically decouple the antenna from the hull of the device upon which the plug is affixed.

This familiar type of assembly has certain disadvantages. The support surface which carries the transducers is a flat surface which also serves as the forward bulkhead of the device. This flat surface therefore must withstand the high hydrostatic pressure to which devices designed for deep submersion are subjected. Since this surface is flat, it must have a very significant mass to withstand such pressures.

Furthermore, since the transducer support is part of the device's resisting structure, the transducers are placed in contact with or close to that structure, and therefore are subjected to the parasitic vibrations which are induced in that structure by the device propeller and by water flow disturbances along the hull. Thus, in the traditional embodiments, there is an intimate mechanical link brought about by hydrostatic pressure between the transducer supports and the device's resisting structure.

SUMMARY OF THE INVENTION

One goal of this invention is to remedy these disadvantages and especially to supply means for building antennas with low parasitic noise levels designed to be used with fast torpedoes which can reach great depths.

Another goal of the invention is to dissociate the transducer support block of the antenna as much as possible from the hull of the device in order to obtain a removable antenna, which can be built separately, that is well isolated acoustically from the hull of the device and that can easily be replaced by another antenna, so that the same device can be equipped with various kinds of antennas, according to the mission for which it is designed.

The goals of the invention are reached with a sonar antenna which forms the inserted head of an underwater device. The antenna includes a core which is a block of rigid syntactic foam that resists submersion hydrostatic pressure. The block includes housings inside each of which an electro-acoustic transducer is placed, with the outer sides of each transducer flush with the outer side of the block. The antenna also includes a sealed envelope, made of acoustically transparent material, which is moulded around the block and transducers. This sealed envelope has a bullet-shaped hydrodynamic profile which extends that of the hull of the device, and a latching means for latching the block against the outer side of the forward end of the hull of the device.

Preferably, the antenna core includes a planar forward side which is perpendicular to the axis of the device and lateral planar facets, with the housings recessed in and perpendicular to the forward side and the lateral facets.

The invention provides new sonar antennas which form an inserted head of an underwater device.

The antenna according to the preferred embodiment, which includes a forward side and several lateral sloped facets, forms a wide sighting range antenna.

The antennas according to the invention display the following advantages, in relation to traditionally used sonar antennas:

acoustic decoupling of the antenna in relation to the hull of the device is improved with the interposing of decoupling fittings between the antenna and the hull;

the transducers, even those which are in a peripheral position, are removed from the resisting structure and form its vibrations;

the antennas according to the invention allow for use of bullet hull shapes, which are well suited to withstanding strong hydrostatic pressures;

they also provide the ability to introduce, inside the block which constitutes the core of the antenna, frames which increase its mechanical resistance, and materials which absorb acoustic vibrations;

cable work is easy due to good access to the link connector.

One important advantage of the antenna according to the invention rests in the fact that it is completely independent from the hull of the device on which it is mounted, whence the possibility to mass produce devices which must be equipped with different antennas and antennas which are designed to equip different devices and to change the current antenna installed in a device for another, in the event of defective operation or of the need to alter the kind of antenna.

BRIEF DESCRIPTION OF THE DRAWINGS

The following description refers to the appended figures which depict, in a non-limiting way, an emobdiment of a sonar antenna according to the invention.

FIG. 3 is an exploded view in an axial half section of the device of FIG. 1.

DETAILED DESCRIPTION OF THE PREFERRED EMBODIMENT

Figure 1:
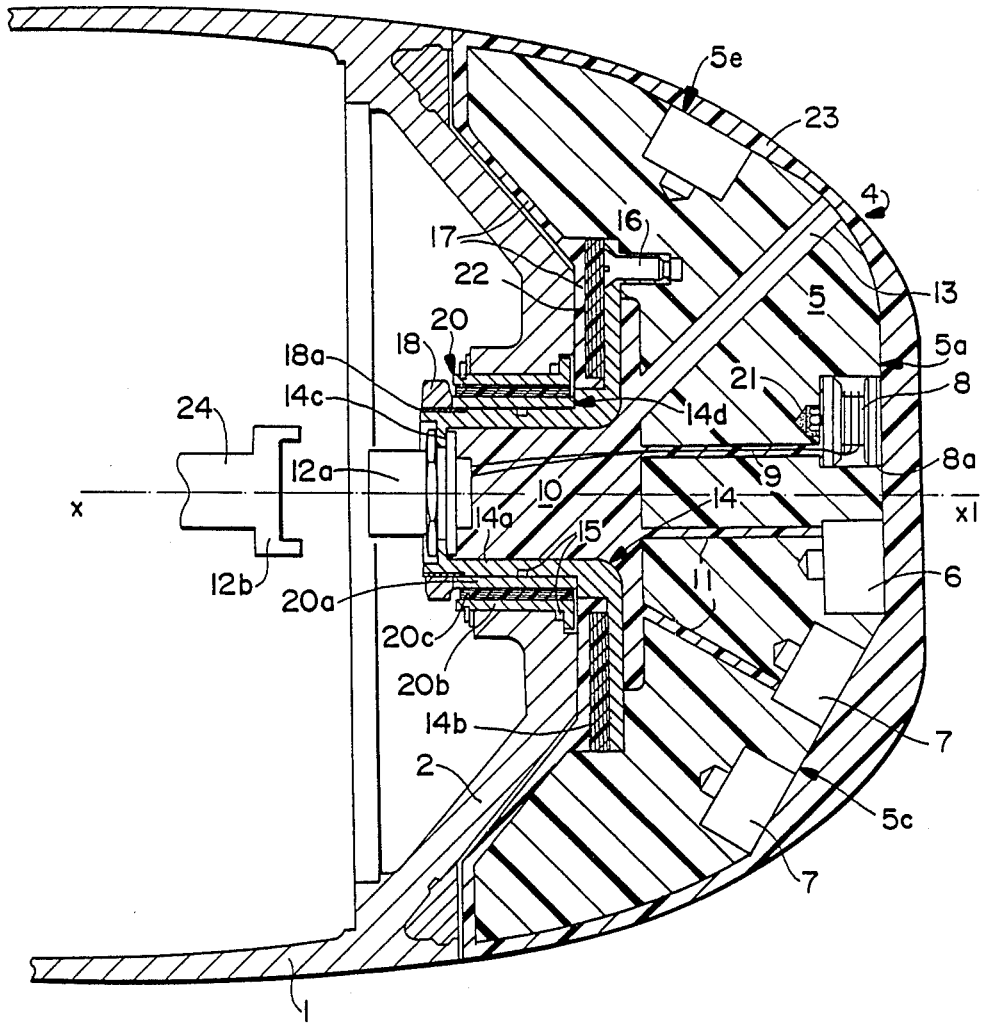
FIG. 1 is an axial section of a preferred embodiment of the present invention.

FIG. 1 is a section through an axial plane of the head of an underwater device or vehicle which surrounds an axis x-x1. A sonar antenna is loaded onto the device and designed to explore the underwater environment at the forward part thereof. The device is, for instance, a torpedo or a towed device or any other underwater device which includes a hollow hull 1.

The hull 1 of the device includes at the front a part 2 which is designed to support the antenna. The part 2 includes an axial bore 3 (see FIG. 3). The hull and the part 2 are designed to resist the potentially significant hydrostatic pressure brought on by submersion.

At the front of the part 2 there is a head 4, the surface of which is profiled to extend the surface of the hull 1, and that has an overall bullet shape surrounding the axis x-x1.

The head 4 forms a sonar antenna which is designed to transmit and receive acoustic waves.

The head 4 includes a body or core 5 of syntactic foam, which is a rigid hardened resin material containing hollow glass or resin microspheres. Syntactic foam possesses enough mechanical resistance to bear the hydrostatic pressure, and has an acoustic impedance distinct from that of the hull and that of the transducers, and a density lower than 1.

The core 5 includes a forward planar side 5*a*, which is perpendicular to axis x-x1, and flat lateral facets, for instance three facets 5*b*, 5*c*, 5*d* (see FIG. 2) which are located arond the central facet, and a small facet 5*e*. The lateral facets are tilted so that they cut across axis x-x1 in front of forward side 5*a*.

Figure 2:
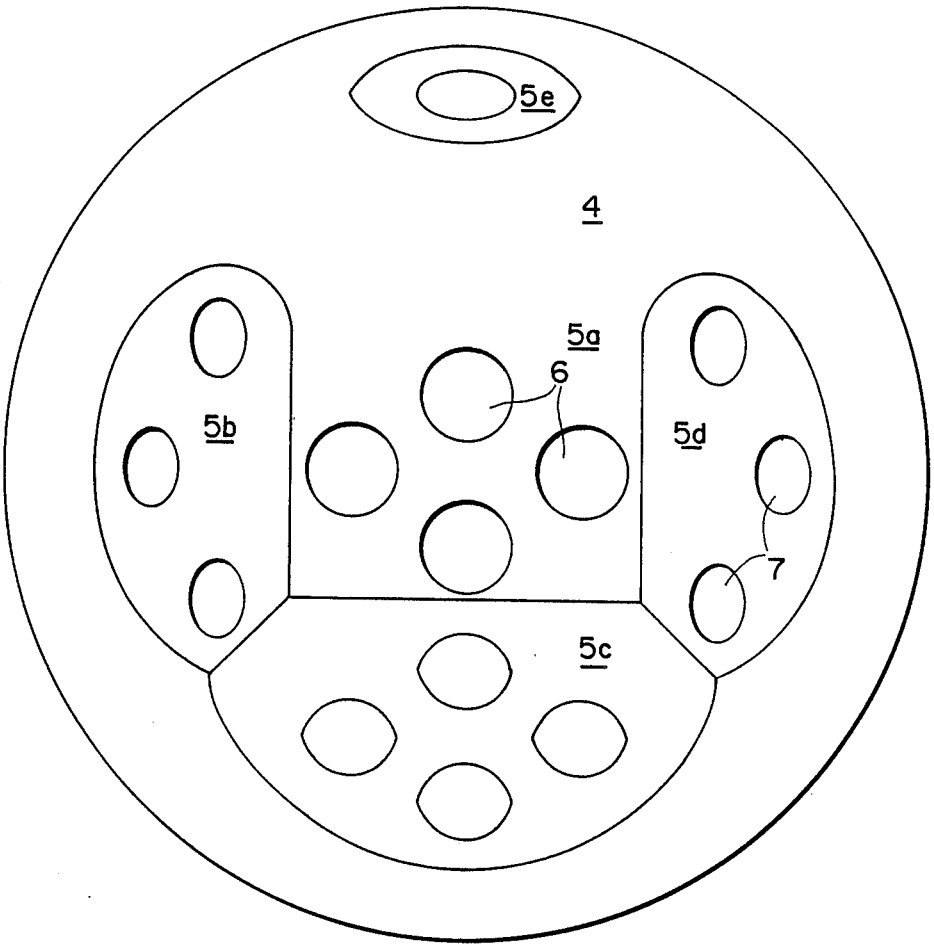
FIG. 2 is a forward end view of the device of FIG. 1.

Recessed housings 6 are formed in block 5 perpendicular to forward side 5*a*, for instance four housings arranged in a diamond, as shown in FIG. 2.

Moreover, recessed housings 7 are formed in block 5 perpendicular to the lateral facets, for instance three housings 7 for each facet 5*b*, 5*c*, 5*d* and a single housing for facet 5*e*. Each housing 6, 7 receives an electro-acoustic transducer 8 (see FIG. 1), for instance a piezo-electric transducer of the Tonpilz type, which includes a ceramic plate piling that alternates with electrodes, arranged between a duct and a countermass. The duct for each transducer carries an O ring 8*a*. The electrodes are connected to electrical conductors 9.

For purposes of illustration, a transducer 8 is depicted only in one recessed housing and conductors 9 for that transducer only are shown.

The transducers 8 represent the elements of a sonar antenna and they fulfill both wave transmitter and receiving hydrophone functions. For instance, one of the transducers from each facet can be a transmitter and the other a receiver or else all the transducers can be alternately transmitters and receivers.

The core 5 includes in its rear part an axial cavity 10.

The recessed housings 6, 7 are linked to the cavity 10 with drillings 11 through which the conductors 9 pass. The cavity 10 includes a connector 12*a* which is used to connect the conductors 9 onto a connector 12*b* that is affixed for instance on a multiconductor cable which connects the antenna to the electronic equipment located inside the device.

Channels 13 are drilled through the block 5 and they connect the central cavity 10 to the outside.

After all the electrical wiring is achieved and the wire passageways have been obstructed, we fill the cavity 10 with a material that pads the acoustic vibrations, for instance an elastomer material with a high muffling coefficient. This material is injected inside the cavity 10 through the channels 13.

The core 5 is mounted on the plate 2 by way of a metal part 14, which includes an axial sleeve 14 a that can extend inside a bore 3.

The part 14 also includes a flange 14*b* which is affixed to the sleeve 14*a* and which is used to mount the part 15 with the core 5. The flange 14*b* can be inserted inside the core 5 during the flow of foam which comprises the core. It can also be mechanically mounted onto the core 5 by being glued and with screws 16. In that case, a flat ring 22 made of syntactic foam is glued onto the rear side of the flange 14*b* in order to improve acoustic decoupling.

The part 14 includes at the rear end a wall 14*c* which is drilled with an orifice on which the connector 12*a* is mounted. The sleeve 14*a* includes an outer shoulder 14*d* which acts as a thrust against a fitting 20 and that maintains an open space 17 between the forward side of the plate 2 and the rear side of the core 5. This open space 17 is used as a housing at the rear side for an envelope 23 made of acoustically transparent material, for instance of budadien or polyurethane resin, with an acoustic impedance (p.c. product) equal to that of water.

The envelope 23 is moulded around the core 5. It forms a sealed envelope which ensures watertightness of the antenna and gives the head a hydrodynamic profile.

FIG. 2 is a front view of the core without the sealed envelope. We can see in this view a preferred example of the arrangement of side facets 5*b*, 5*c*, 5*d*, 5*e* and housings 6, 7 on those facets.

As shown in FIG. 1, the apparatus includes a member for fastening the antenna onto the hull which is comprised for instance of a bolt 18 which is screwed into the threaded end 18*a* of sleeve 14*a*, that enters inside the hull. The bolt 18 is supported by an acoustic decoupling fitting 20.

In order to improve acoustic decoupling between the antenna and the hull of the device, the bore 3 includes a decoupling fitting 20. This fitting 20 is comprised of two concentric rings 20*a*, 20*b*, which are separated by an intermediate ring 20*c* made of material which absorbs acoustic vibrations. Joints 15 which are placed in grooves ensure the watertightness of the sleeve passage 14*a* and of the fitting 20 through the bore 3.

The transducers 8 are glued at the bottom of their housings 6, 7 with an adhesive compound 21, for instance an epoxy resin compound, which is also used to regulate the position of the transducer in the housing so that the forward side of the transducer is flush with the surface of the side 5*a* or one of the facets 5*b*, 5*c*, 5*d*, 5*e* of the core.

FIG. 3 is an exploded view which makes it possible to explain the manufacturing and assembly steps of a sonar antenna according to the invention.

We begin by manufacturing a core 5 with syntactic rigid foam which includes an axial cavity 10, a forward flat side 5*a*, lateral sides 5*b*, 5*c*, 5*d*, 5*e* and recessed housings 6, 7 (see FIGS. 1 and 2).

The core 5 is obtained by molding molten foam in a mold which includes protrusions corresponding to the axial cavity 10 and to the housings 6, 7.

The flange 14*b* of the metal connecting part 14 can be inserted inside the foam during the casting or else it can be set on the core after stripping it from the mold.

Then we place an electro-acoustic transducer 8 in each recessed housing 6, 7 after having poured an adhesive compound 21 in its bottom. We regulate the position of each transducer in its housing so that the forward side of the transducer is flush with the flat side 5*a* or the plane of the lateral facets. We then install the electrical connections for each transducer on half 12*a* of an electric connector which we place in the axial cavity 10, and we then fill the axial cavity 10 with material that muffles acoustic vibrations, for instance a heavy elastomer.

To complete the assembly of this antenna, we mold a sealed envelope 23 made of acoustically transparent material around the entire unit, including the core equipped with transducers and the linkage part 14. The O rings 8*a* (see FIG. 1) prevent the envelope material from entering inside the housings 6, 7. The sealed envelope 23 is shaped like a bullet which extends the lengthwise profile of the hull 1 of the device.

In order to set the antenna on the device, we first engage a fitting 20 in the axial bore 3, so that the threaded end 18*a* of the part 14*a* enters inside the device. We screw a bolt 18 onto the threaded end 18*a*, which maintains the antenna in its place, and we connect the second half 12*b* of the connector 12 having the end of a linkage cable 24 affixed to the antenna.

We see that a sonar antenna 4 according to the invention is manufactured completely independent from the device on which it must be loaded and that affixing the antenna on the device is extremely simple. Therefore it is possible to mass produce identical devices or device hulls and to fit them out with different antennas, which are separately mass produced.

It is also possible to replace the head of a device with another that contains a different antenna.

In order to reinforce the mechanical resistance of the antenna so that it can resist strong hydrostatic pressures and shocks, we can provide the core 5 with a skeleton.

The description which precedes refers to an example of an antenna which surrounds the axis of the device and which includes facets. This example is not limiting and the antennas according to the invention can also include a plane-shaped core, with all the transducers arranged inside housings therein that are parallel to the axis x-x1 of the device, and where the envelope 23 gives the head a hydrodynamic shape.

What is claimed is:

1. A method for manufacturing a sonar antenna, comprising:

casting a core block of syntactic foam sufficiently rigid to withstand submersion hydrostatic pressures, said block having an axial cavity, facets, and recessed housings formed in an outer surface thereof;

forming passages connecting each of said recessed housings to said axial cavity and at least one channel connecting said axial cavity to said outer surface of said block;

mounting at least one electro-acoustic transducer in each recessed housing such that an outer surface of each said transducer is flush with said outer surface of said block;

placing an electrical connector in said axial cavity for connection to a hull of an underwater device, and connecting each said electro-acoustic transducer to said electrical connector thereto by way of electrical conductors extending through said passages;

filling said axial cavity, passages and channel with a muffling material by injecting the muffling material through said channel;

attaching means to said block for fastening said block against a forward end of the hull of the underwater device; and molding a sealed envelope of acoustically transparent material around said block and transducers, said envelope being formed substantially in a bullet shape to serve as the front end of an underwater device.

2. The method of claim 1, wherein each said at least one electro-acoustic transducer is glued in a corresponding recessed housing such that an outer surface of each said transducer is flush with said outer surface of said block.

3. The method of claim 1, wherein said fastening means comprises a flanged sleeve, a flange of the flanged sleeve being attached to a rear side of said block.

4. A sonar antenna for use as the head of an underwater device, comprising:

a core block of syntactic foam sufficiently rigid to withstand submersion hydrostatic pressures, said block having an axial cavity, facets, and recessed housings formed in an outer surface thereof;

passages connecting each of said recessed housings to said axial cavity, and at least one channel connecting said axial cavity to said outer surface of said block;

at least one electro-acoustic transducer mounted in each recessed housing, such that an outer surface of each said transducer is flush with said outer surface of said block;

an electrical connector disposed in said axial cavity for connection to a hull of an underwater device, and electrical conductors extending through said passages and connecting each said transducer to said electrical connector;

a muffling material in said axial cavity, said passages and said at least one channel;

means for fastening said block against a forward end of the hull of the underwater device; and an acoustically transparent, sealed envelope around said block and transducers, said sealed envelope having a substantially bullet shape to serve as the front end of said underwater device.

5. The sonar antenna of claim 4, wherein said outer surface of said block comprises a substantially flat surface perpendicular to a central axis of rotation at a forward end thereof, and a plurality of lateral flat facets disposed on sides of said block and spaced about said axis, said housings being formed in said forward end and lateral facets.

6. The sonar antenna of claim 5, wherein each said lateral facet is disposed substantially in a plane tilted relative to said axis so as to intersect said axis in front of said forward end.

7. The sonar antenna of claim 4, further comprising epoxy resin to hold each transducer in a corresponding housing with said surface thereof flush with said outer surface of said block.

8. The sonar antenna of claim 4, wherein said fastening means comprises a sleeve having a flange thereon, said flange being affixed to said block and said sleeve extending away from said block and being insertable into the hull of said underwater device.

9. The sonar antenna of claim 8, wherein said fastening means further comprises an acoustic decoupling fitting between said block and the hull of the underwater device, said fitting comprising two concentric rings disposed about said sleeve, and an intermediate ring made of material which muffles acoustic waves disposed between said two concentric rings.

10. The sonar antenna of claim 8, wherein an end of said sleeve which extends away from said block is threaded, and said fastening means further comprises a nut which is screwed onto said threaded end to hold said sonar antenna to said hull.

* * * * *